US010288069B2

(12) United States Patent
Shoulders

(10) Patent No.: US 10,288,069 B2
(45) Date of Patent: May 14, 2019

(54) REFRIGERANT COMPRESSOR LUBRICANT VISCOSITY ENHANCEMENT

(71) Applicant: Carrier Corporation, Farmington, CT (US)

(72) Inventor: Stephen L. Shoulders, Baldwinsville, NY (US)

(73) Assignee: CARRIER CORPORATION, Farmington, CT (US)

( * ) Notice: Subject to any disclaimer, the term of this patent is extended or adjusted under 35 U.S.C. 154(b) by 423 days.

(21) Appl. No.: 15/104,647

(22) PCT Filed: Oct. 16, 2014

(86) PCT No.: PCT/US2014/060799
§ 371 (c)(1),
(2) Date: Jun. 15, 2016

(87) PCT Pub. No.: WO2015/094464
PCT Pub. Date: Jun. 25, 2015

(65) Prior Publication Data

US 2016/0312781 A1 Oct. 27, 2016

Related U.S. Application Data

(60) Provisional application No. 61/917,643, filed on Dec. 18, 2013.

(51) Int. Cl.
*F04C 29/02* (2006.01)
*F04C 18/16* (2006.01)
(Continued)

(52) U.S. Cl.
CPC ..... *F04C 29/028* (2013.01); *F01C 21/108* (2013.01); *F04B 39/0284* (2013.01); *F04C 18/16* (2013.01); *F04C 2240/50* (2013.01)

(58) Field of Classification Search
CPC ..... F04B 39/0284; F04C 29/028
See application file for complete search history.

(56) References Cited

U.S. PATENT DOCUMENTS 3,534,564 A 10/1970 Miller
4,181,474 A 1/1980 Shaw
(Continued)

FOREIGN PATENT DOCUMENTS

EP 0758054 A1 2/1997
EP 2647846 A1 10/2013
(Continued)

OTHER PUBLICATIONS

Machine translation of JP 2010090707 (A); translated on Oct. 2018.*
(Continued)

*Primary Examiner* — Mary Davis
(74) *Attorney, Agent, or Firm* — Cantor Colburn LLP

(57) ABSTRACT

A compressor assembly is provided including an inlet bearing and an outlet bearing. A rotating compressor member is support for rotation on an inlet end by the inlet bearing and on an outlet end by the outlet bearing. A plurality of connecting passages is configured to supply lubricant to the inlet bearing and the outlet bearing. A first lubricant flow path is arranged downstream from a pressure reducing orifice. The first lubricant flow path is fluidly coupled to at least one of the plurality of connecting passages. At least a portion of the first lubricant flow path is arranged in a heat exchange relationship with a hot gas in discharge port such that the lubricant within the first lubricant flow path increases in viscosity.

18 Claims, 6 Drawing Sheets

(51) Int. Cl.
*F04B 39/02* (2006.01)
*F01C 21/10* (2006.01)

(56) References Cited

U.S. PATENT DOCUMENTS

| | | | | |
|---|---|---|---|---|
| 4,478,054 | A * | 10/1984 | Shaw | F04C 29/026 418/201.2 |
| 4,780,061 | A | 10/1988 | Butterworth | |
| 5,370,513 | A | 12/1994 | Fain | |
| 5,765,392 | A * | 6/1998 | Baur | F04C 29/02 418/97 |
| 5,947,709 | A | 10/1999 | Koyama et al. | |
| 6,658,885 | B1 | 12/2003 | Zhou et al. | |
| 7,347,301 | B2 | 3/2008 | Sekiya et al. | |
| 7,553,142 | B2 * | 6/2009 | Zinsmeyer | F04C 29/028 418/201.1 |
| 7,836,696 | B2 | 11/2010 | Uno et al. | |
| 7,870,733 | B2 | 1/2011 | Uno et al. | |
| 8,287,259 | B2 * | 10/2012 | Yoshimura | F04C 29/028 384/590 |
| 8,491,280 | B2 | 7/2013 | Kameya et al. | |
| 2004/0118132 | A1 | 6/2004 | Shoulders | |

FOREIGN PATENT DOCUMENTS

| | | | |
|---|---|---|---|
| JP | S57135292 | A | 8/1982 |
| JP | H07103583 | A | 4/1995 |
| JP | H1038429 | A | 2/1998 |
| JP | H10159764 | A | 6/1998 |
| JP | H11142005 | A | 5/1999 |
| JP | H11294364 | A | 10/1999 |
| JP | 2002535539 | A | 10/2002 |
| JP | 2006508322 | A | 3/2006 |
| JP | 2010090707 | A | 4/2010 |
| WO | 2005061900 | A1 | 7/2005 |

OTHER PUBLICATIONS

Notification of Transmittal of the International Search Report and the Written Opinion of the International Searching Authority, or the Declaration for International Application No. PCT/US2014/060799 dated Jan. 7, 2015; dated Jan. 21, 2015; 10 pages.

State Intellectual Property Office, P.R. China, Decision of Rejection for Patent Application No. 201480069075.3, dated Jun. 29, 2018 (13 pp.).

State Intellectual Property Office, P.R. China, First Office Action for Patent Application No. 201480069075.3, dated Jul. 24, 2017 (21 pp.).

State Intellectual Property Office, P.R. China, Second Office Action for Patent Application No. 201480069075.3, dated Apr. 2, 2018 (14 pp.).

* cited by examiner

REFRIGERANT COMPRESSOR LUBRICANT VISCOSITY ENHANCEMENT

CROSS-REFERENCE TO RELATED APPLICATION

This application claims the benefit of U.S. provisional patent application Ser. No. 61/917,643 filed Dec. 18, 2013, the entire contents of which are incorporated herein by reference.

BACKGROUND OF THE INVENTION

The invention relates generally to chiller refrigeration systems and, more particularly, to separation of lubricant from refrigerant in a compressor of a chiller refrigeration system.

Refrigerant systems are utilized in many applications to condition an environment. The cooling or heating load of the environment may vary with ambient conditions, occupancy level, other changes in sensible and latent load demands, and as the temperature and/or humidity set points are adjusted by an occupant of the environment.

Use of a variable speed drive for the compressor motor improves the efficiency of refrigerant systems. Often, the compressor need not be operated at full speed, such as when the cooling load on the refrigerant system is relatively low. Under such circumstances, it might be desirable to reduce the compressor speed, and thus reduce the overall energy consumption of the refrigerant system. Implementation of a variable speed drive is one of the most efficient techniques to enhance system performance and to reduce life-cycle cost of the equipment over a wide spectrum of operating environments and potential applications, especially at part-load conditions.

However, compelling reliability concerns limit the allowable compressor speed reduction. In particular, inadequate lubrication of the compressor elements such as bearings may present a problem at low operating speeds. Speed dependent reliability concerns arise because damaging contact may occur between two surfaces in close proximity depending on their relative speed and the viscosity of the lubricant between them. As the speed is reduced, the viscosity of the lubricant must be increased to maintain a separating film between the two surfaces. Lubricant viscosity levels that occur in conventional compressor lubrication systems, which are designed for operation at relatively high constant speeds, are not sufficient to ensure reliability at the lowest speeds desired for variable speed operation.

Most oils used in refrigerant screw compressors form a solution of refrigerant and oil. Refrigerant dilutes the oil, lowering the viscosity of the resultant oil-refrigerant solution compared to the viscosity of pure oil. The amount of refrigerant dissolved in oil in a stable solution is a chemically determined function of pressure and temperature. Suitable changes in pressure and temperature of the oil-refrigerant solution, usually pressure reduction and temperature increase, can cause refrigerant to out-gas from the solution as a new equilibrium state develops. Such occurrences of out-gassing generally increase viscosity because they reduce the level of dilution. Complete out-gassing required to reach a new equilibrium state is not instantaneous. Time required can be reduced somewhat by agitating the lubricant during the out-gassing process.

A known method of increasing viscosity of refrigerant-diluted lubricants that is currently used in some conventional compressors and in variable speed compressors with limited speed range introduces pressure reduction in the lubricant flow prior to its introduction to bearings. This is typically accomplished by venting the housing cavity containing the bearings to a relatively low pressure region within the compressor and by locating an orifice in the lubricant flow path upstream of bearings. The flow restriction imposed by the orifice introduces a pressure drop that may induce some out-gassing of refrigerant. While this approach offers some increase in lubricant viscosity, it has been found to be insufficient to allow operation to the lowest speeds desired.

Due to the minimum speed limitation that must be imposed to ensure reliability, some of the energy efficiency that could be potentially provided by the variable speed drive is essentially eliminated. Thus, there is a need to provide a compressor that can reliably operate at a lower speed than what can be achieved with current designs.

BRIEF DESCRIPTION OF THE INVENTION

According to an aspect of the invention, a compressor assembly is provided including an inlet bearing and an outlet bearing. A rotating compressor member is support for rotation on an inlet end by the inlet bearing and on an outlet end by the outlet bearing. A plurality of connecting passages is configured to supply lubricant to the inlet bearing and the outlet bearing. A first lubricant flow path is arranged downstream from a pressure reducing orifice. The first lubricant flow path is fluidly coupled to at least one of the plurality of connecting passages. At least a portion of the first lubricant flow path is arranged in a heat exchange relationship with a hot gas in discharge port such that the lubricant within the first lubricant flow path increases in viscosity.

In addition to one or more of the features described above, or as an alternative, in further embodiments the first lubricant flow path includes a plurality of turns configured to increase a distance of the portion of the first lubricant flow path in a heat transfer relationship with the hot gas.

In addition to one or more of the features described above, or as an alternative, in further embodiments the first lubricant flow path includes a conduit positioned within the hot refrigerant gas in the discharge port.

In addition to one or more of the features described above, or as an alternative, in further embodiments at least a portion of the first lubricant flow path wraps around an insert located within an opening of a compressor housing.

In addition to one or more of the features described above, or as an alternative, in further embodiments the first lubricant flow path extends generally helically from a first end to a second end of the insert.

In addition to one or more of the features described above, or as an alternative, in further embodiments the first lubricant flow path is formed into an exterior surface of the insert.

In addition to one or more of the features described above, or as an alternative, in further embodiments the opening configured to receive the insert is formed in a portion of the compressor housing located centrally in the discharge port.

In addition to one or more of the features described above, or as an alternative, in further embodiments the first lubricant flow path is integrally formed with a compressor housing.

In addition to one or more of the features described above, or as an alternative, in further embodiments the first lubricant flow path is formed about a circumference of a chamber of the discharge port.

In addition to one or more of the features described above, or as an alternative, in further embodiments a second lubricant flow path is fluidly coupled to at least one of the plurality of connecting passages. At least a portion of the second lubricant flow path is arranged in a heat exchanger relationship with a hot gas in the discharge port such that a lubricant within the second flow path increases in viscosity.

In addition to one or more of the features described above, or as an alternative, in further embodiments the first lubricant flow path is fluidly coupled to a first connecting passage and the second lubricant flow path is fluidly coupled to a second connecting passage.

According to another embodiment of the invention, a lubrication system for a movable component is provided including a reservoir configured to store a supply of lubricant. A lubricant flow path is fluidly coupled to the reservoir. An inlet of the lubricant flow path is arranged generally downstream from a pressure reducing orifice. At least a portion of the lubricant flow path is arranged in a heat exchanger relationship with a hot heating medium such that the lubricant within the lubricant flow path increases in viscosity. At least one connecting passage extends between an outlet of the lubricant flow path and the movable component.

In addition to one or more of the features described above, or as an alternative, in further embodiments the lubricant flow path includes a plurality of turns configured to increase a distance of the portion of the lubricant flow path in a heat transfer relationship with the hot heating medium, In addition to one or more of the features described above, or as an alternative, in further embodiments the lubrication system includes a plurality of lubricant flow paths. Each lubricant flow path is connected to a corresponding connecting passage to provide lubricant having an increased viscosity to at least one movable component.

In addition to one or more of the features described above, or as an alternative, in further embodiments the hot heating medium is provided from a condenser of a refrigeration system.

In addition to one or more of the features described above, or as an alternative, in further embodiments the hot heating medium is refrigerant from a discharge port of a compressor of a refrigeration system.

In addition to one or more of the features described above, or as an alternative, in further embodiments at least a portion of the lubricant low path includes a conduit positioned within the discharge port of the compressor.

In addition to one or more of the features described above, or as an alternative, in further embodiments at least a portion of the lubricant flow path wraps around an insert located within an opening of a compressor housing.

In addition to one or more of the features described above, or as an alternative, in further embodiments the lubricant flow path is integrally formed with a compressor housing.

In addition to one or more of the features described above, or as an alternative, in further embodiments the movable component is a bearing of a compressor.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
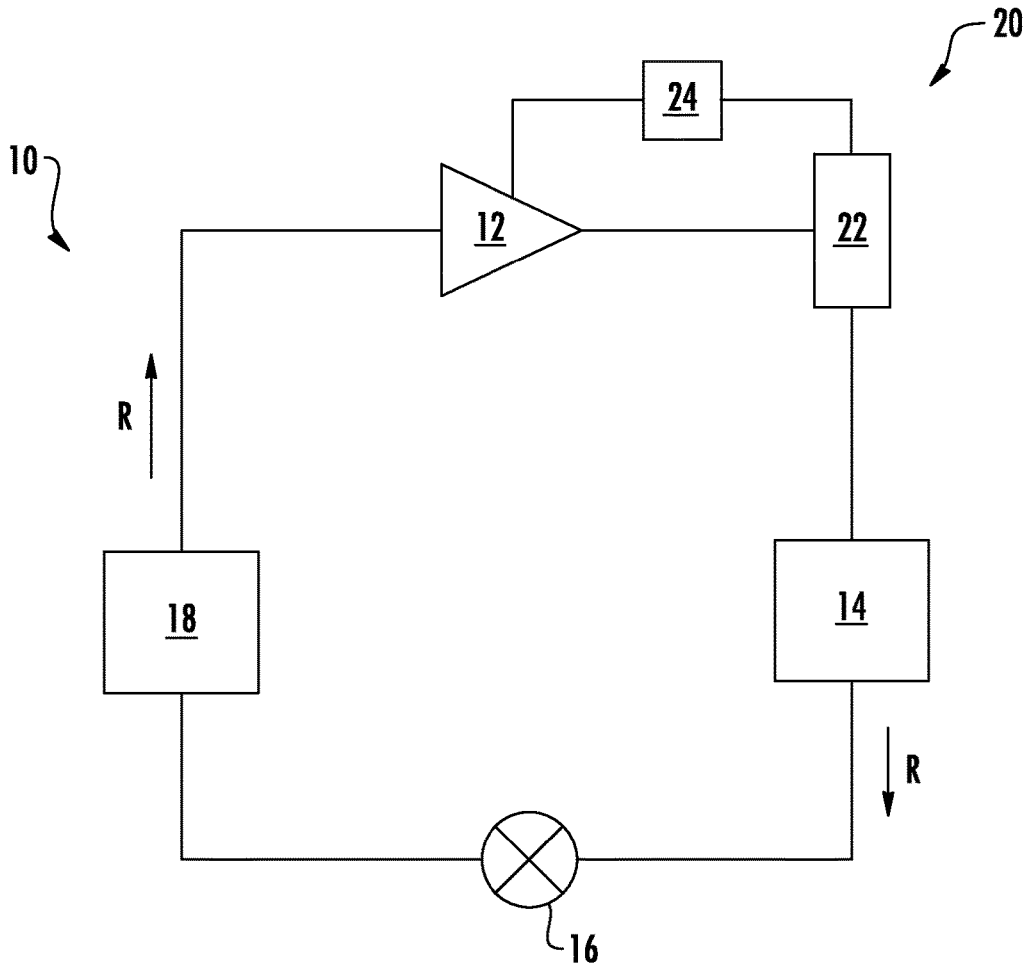
FIG. 1 is a schematic diagram of an example of a refrigeration system.

Referring now to FIG. 1, a conventional vapor compression or refrigeration cycle 10 of an air conditioning system is schematically illustrated. A refrigerant R is configured to circulate through the vapor compression cycle 10 such that the refrigerant R absorbs heat when evaporated at a low temperature and pressure and releases heat when condensed at a higher temperature and pressure. Within this cycle 10, the refrigerant R flows in a clockwise direction as indicated by the arrows. The compressor 12 receives refrigerant vapor from the evaporator 18 and compresses it to a higher temperature and pressure, with the relatively hot vapor then passing to the condenser 14 where it is cooled and condensed to a liquid state by a heat exchange relationship with a cooling medium such as air or water. The liquid refrigerant R then passes from the condenser 14 to an expansion valve 16, wherein the refrigerant R is expanded to a low temperature two phase liquid/vapor state as it passes to the evaporator 18. After the addition of heat in the evaporator, low pressure vapor then returns to the compressor 12 where the cycle is repeated.

A lubrication system, illustrated schematically at 20, may be integrated into the air conditioning system. Because lubricant may become entrained in the refrigerant as it passes through the compressor 12, an oil separator 22 is positioned directly downstream from the compressor 12. The refrigerant separated by the oil separator 22 is provided to the condenser 14, and the lubricant isolated by the oil separator 22 is provided to a lubricant reservoir 24 configured to store a supply of lubricant. Lubricant from the reservoir 24 is then supplied to some of the moving portions of the compressor 12, such as to the rotating bearings for example, where the lubricant becomes entrained in the refrigerant and the cycle is repeated.

Figure 2:
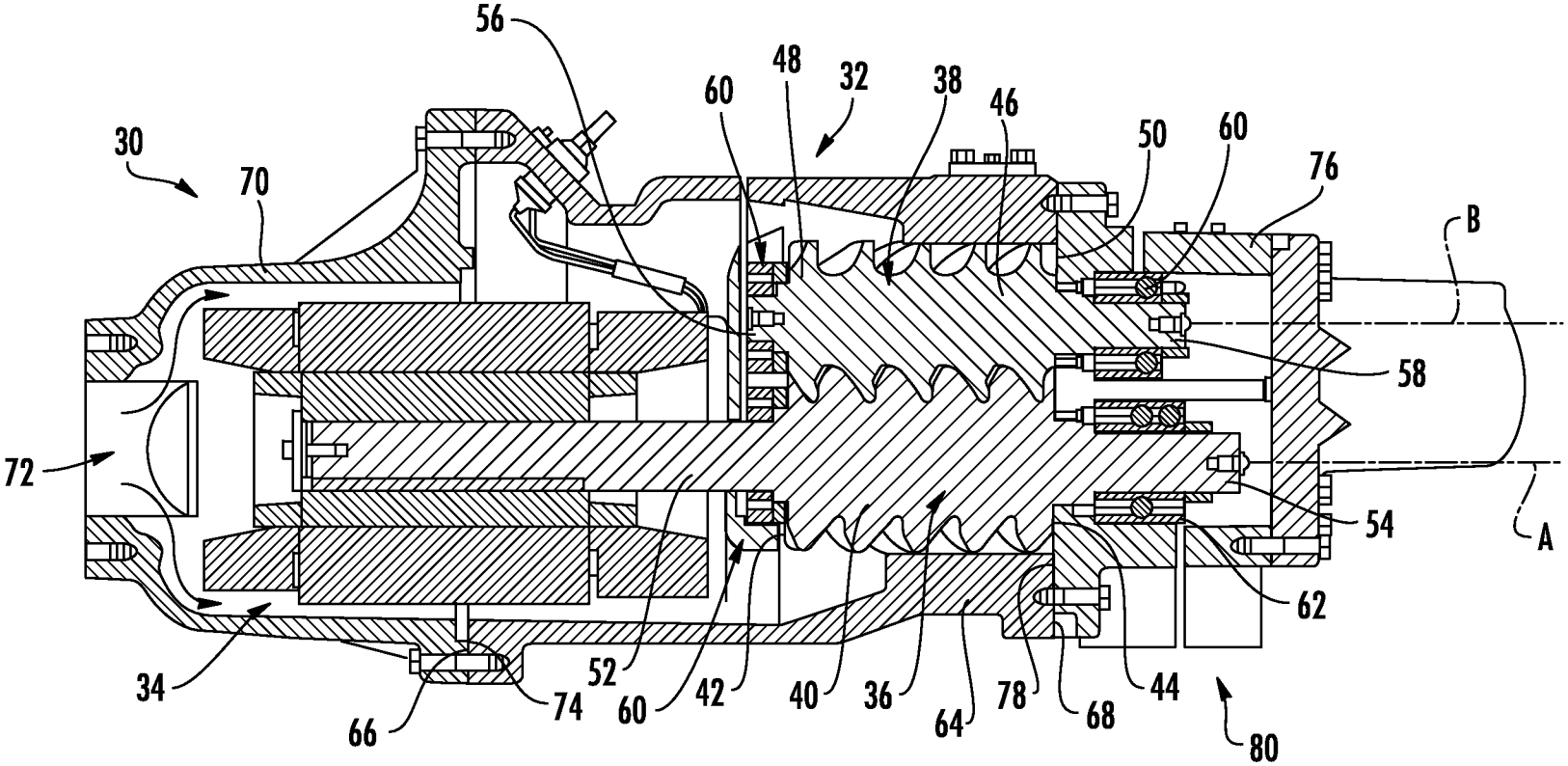
FIG. 2 is a simplified cross-sectional view of a screw compressor of a refrigeration system.

Referring now to FIG. 2, an example of a screw compressor 12, commonly used in air conditioning systems, is illustrated in more detail. The screw compressor 12 includes a housing assembly 32 containing a motor 34 and two or more intermeshing screw rotors 36, 38 having respective central longitudinal axes A and B. In the exemplary embodiment, rotor 36 has a male lobed body 40 extending between a first end 42 and a second end 44. The male lobed body 40 is enmeshed with a female lobed body 46 of the other rotor 38. The working portion 46 of rotor 38 has a first end 48 and a second end 50. Each rotor 36, 38 includes shaft portions 52, 54, 56, 58 extending from the first and second ends 42, 44, 48, 50 of the associated working portion 40, 46. Shaft portions 52 and 56 are mounted to the housing 32 by one or more inlet bearings 60 and shaft portions 54 and 58 are mounted to the housing 32 by one or more outlet bearings 62 for rotation about the associated rotor axis A, B.

In the exemplary embodiment, the motor 34 and a shaft portion 52 of rotor 36 may be coupled so that the motor 34 drives that rotor 36 about its axis A. When so driven in an operative first direction, the rotor 36 drives the other rotor 38 in an opposite second direction. The exemplary housing assembly 32 includes a rotor housing 64 having an upstream/inlet end face 66 and a downstream/discharge end face 68 essentially coplanar with the rotor second ends 44 and 50. Although a particular compressor type and configuration is illustrated and described herein, other compressors, such as having three rotors for example, are within the scope of the invention.

The exemplary housing assembly 32 further comprises a motor/inlet housing 70 having a compressor inlet/suction port 72 at an upstream end and having a downstream face 74 mounted to the rotor housing upstream face 66 (e.g., by bolts through both housing pieces). The assembly 32 further includes an outlet/discharge housing 76 having an upstream face 78 mounted to the rotor housing downstream face 68 and having an outlet/discharge port 80. The exemplary rotor housing 64, motor/inlet housing 70, and outlet housing 76 may each be formed as castings subject to further finish machining.

Referring now to FIGS. 3-6, the lubrication system 20 includes a lubricant flow path 100 configured to increase the viscosity of the lubricant flowing there through before being provided to the inlet and outlet bearings of the compressor 12. The flow path 100 is located generally downstream from an orifice 90 (FIG. 5) configured to provide a pressure drop in the lubricant flowing through orifice 90 into flow path 100. As a result of this pressure drop, some refrigerant may out-gas from the oil-refrigerant lubricant solution. The temperature of lubricant and out-gassed refrigerant vapor in lubricant flow path 100 downstream of the orifice 90 will be lower than the lubricant temperature upstream of orifice 90 due to the thermodynamic state relationships of refrigerant.

At least a portion of the lubricant flow path 100 is arranged in a heat transfer relationship with a hot heating medium. This heat transfer relationship may be achieved by positioning the flow path 100 adjacent to or within one of the components of the vapor compression cycle 10, such as the compressor 12 or the condenser 14 for example. In one embodiment, at least a portion of the lubricant flow path 100 is arranged within the discharge housing 76 near the discharge port or plenum 80 such that lubricant located therein is in a heat exchange relationship with the hot, compressed refrigerant gas in the discharge port 80 of the compressor 12. A portion of the heat from the refrigerant gas transfers to the lower temperature lubricant solution in the lubricant flow path 100, causing at least some of the refrigerant in the oil-refrigerant lubricant solution to vaporize or out-gas. As a result, the lubricant solution is less diluted by refrigerant and its viscosity therefore increases.

Figure 3:
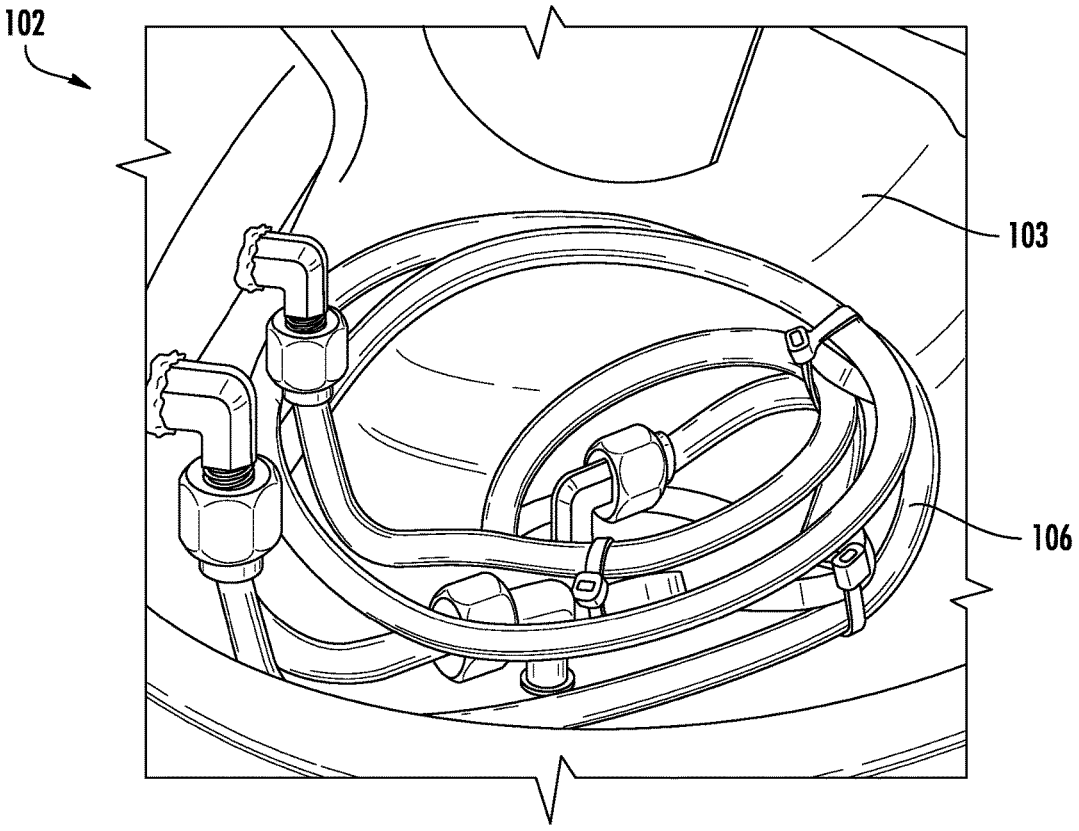
FIG. 3 is a perspective view of a discharge port of a compressor according to an embodiment of the invention.

The lubricant flow path 100 may include a plurality of turns, such as about a circumference of one of the chambers (not shown) of the discharge port 80 for example. The plurality of turns not only agitate the lubricant as it flows there through, but also increases the length of the lubricant flow path 100 and therefore the amount of time that the lubricant is in a heat exchange relationship with the heating medium. In one embodiment, the lubricant flow path 100 is formed by a coiled conduit 106 physically arranged within the discharge plenum 102 near the discharge port 80 (FIG. 3).

Figure 4:
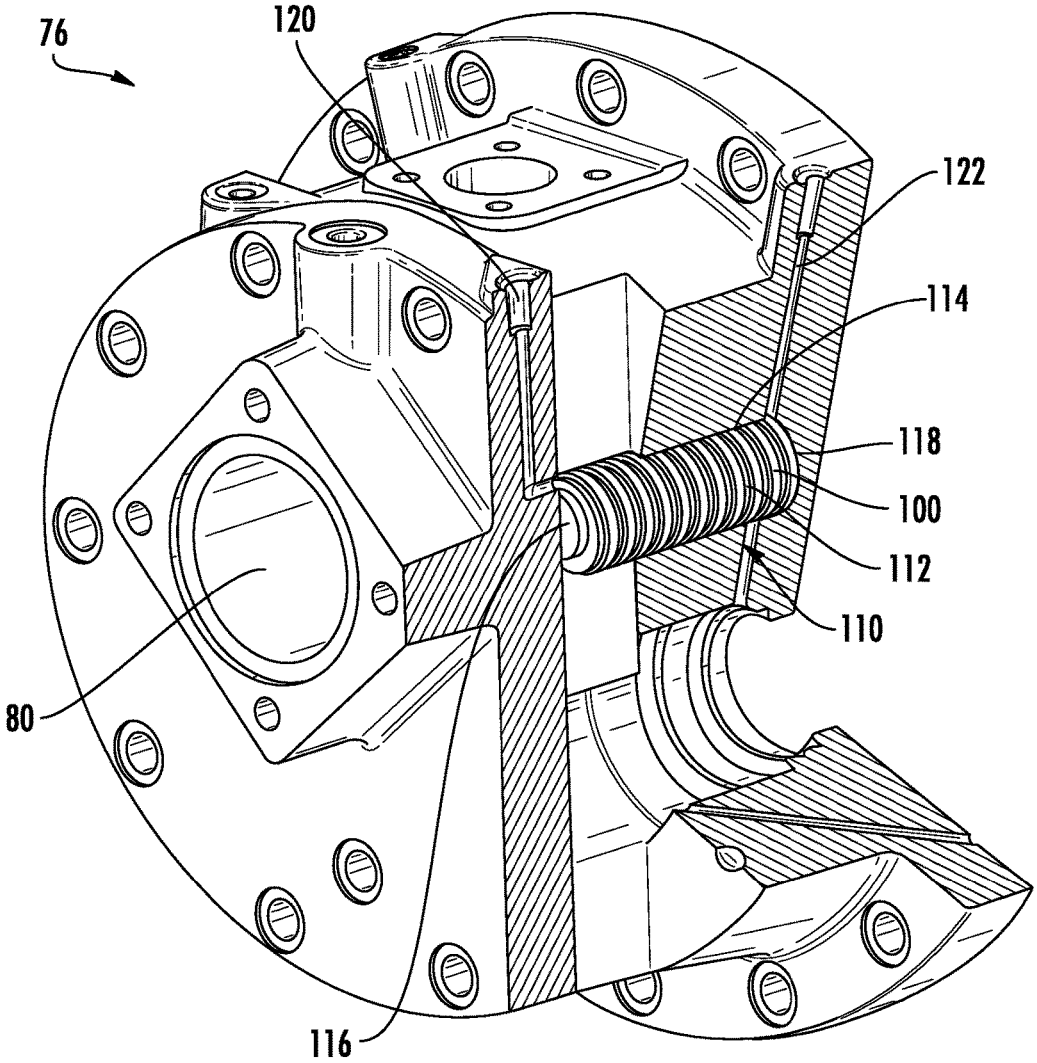
FIG. 4 is a perspective, partially cut away view of a discharge housing of a compressor according to an embodiment of the invention.

Referring now to FIG. 4, an insert 110 having a lubricant flow path 100 formed about the exterior surface 112 thereof is arranged within an opening 114 in the discharge housing 76, adjacent the discharge port 80. In the illustrated, non-limiting embodiment, the insert 110 is generally cylindrical in shape and a helical lubricant flow path 100 extends over at least a portion of the length of the insert 110, such as from a first end 116 to a second, opposite end 118 for example.

Figure 5:
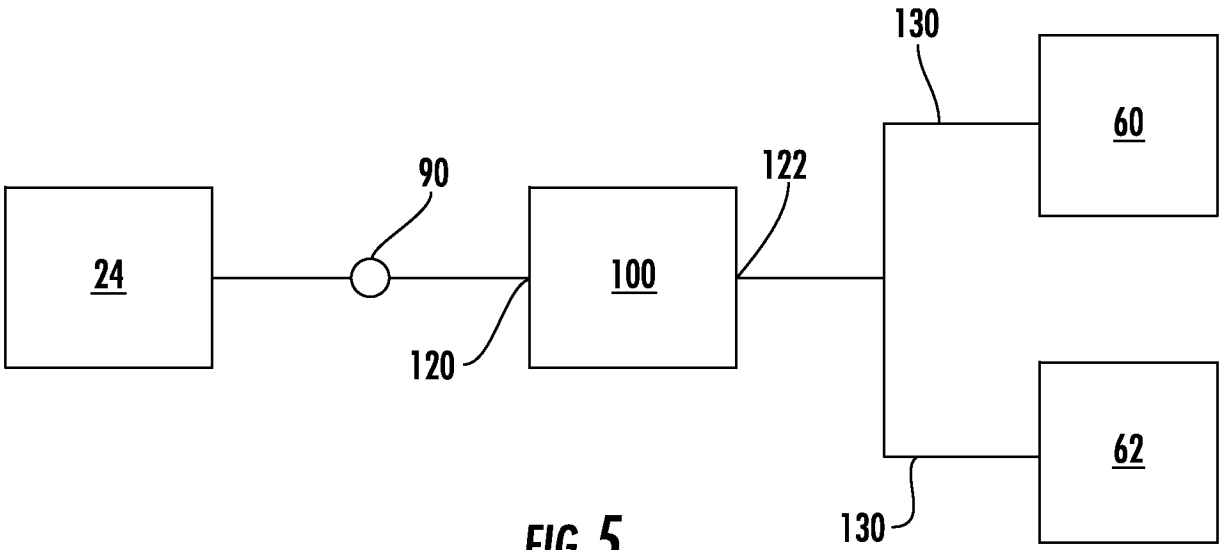
FIG. 5 is a schematic diagram of the lubrication system of the refrigeration system according to an embodiment of the invention.
Figure 6:
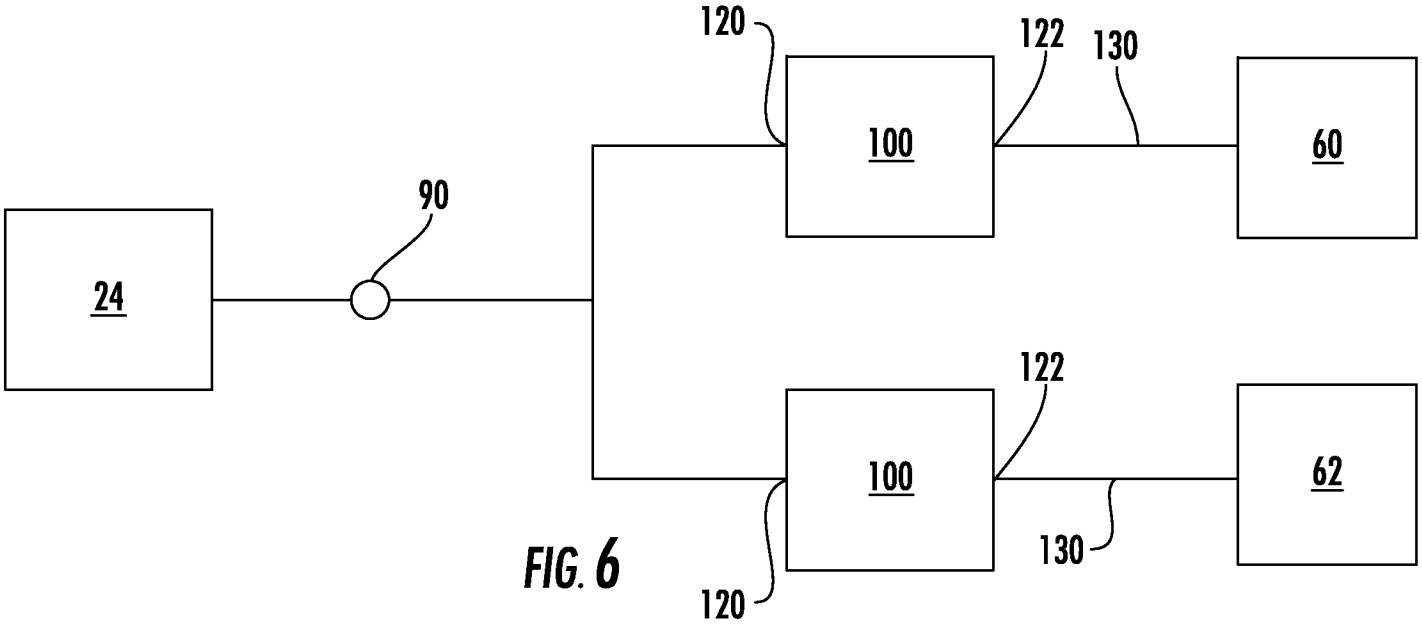
FIG. 6 is a schematic diagram of the lubrication system of the refrigeration system according to another embodiment of the invention.

As illustrated schematically in FIG. 5, the lubricant reservoir 24 is fluidly coupled to an inlet 120 of the lubricant flow path 100 such that lubricant from the reservoir 24 is supplied to the lubricant flow path 100 downstream of the orifice 90. An outlet 122 of the lubricant flow path 100 is fluidly connected to at least one of the bearings 60, 62 configured to drain to a low pressure region of the compressor 12 by a connecting passage 130. In one embodiment, the outlet 122 of the lubricant flow path 100 is operably coupled to a plurality of connecting passages 130 such that lubricant from the lubricant flow path 100 is provided to all of the bearings 60, 62 in the compressor. In another embodiment, illustrated in FIG. 6, the lubrication system 20 includes a plurality of lubricant flow paths 100 configured to increase the viscosity of the lubricant therein. Each of the lubricant flow paths 100 may be configured to supply lubricant to one or more of the bearings 60, 62 of the compressor 12. For example, a first lubricant flow path 100 may be configured to supply lubricant to the inlet bearings 60 and a second lubricant flow path 100 may be configured to supply lubricant to the outlet bearings 62, as illustrated. Alternatively, the lubrication system 20 may include a plurality of lubricant flow paths 100, each flow path 100 being configured to provide lubricant having an increased viscosity to an individual inlet or outlet bearing 60, 62 of the compressor 12.

By incorporating at least one lubricant flow path 100 near the discharge port 80 of the compressor 12, the viscosity of the lubricant being supplied to the bearings 60, 62 of the compressor 12 is increased. As a result, the compressor 12 is able to operate at slower speeds with a reduced likelihood of bearing damage occurring.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A compressor assembly, comprising:

an inlet bearing;

an outlet bearing;

a rotating compressor member supported for rotation on an inlet end by the inlet bearing and on an outlet end by the outlet bearing;

a plurality of connecting passages for supplying lubricant to the inlet bearing and the outlet bearing; and a first lubricant flow path arranged downstream of a pressure reducing orifice, the first lubricant flow path being fluidly coupled to at least one of the plurality of connecting passages, wherein at least a portion of the first lubricant flow path is arranged in a heat exchange relationship with a hot gas in a discharge port such that a lubricant within the first lubricant flow path increases in viscosity and the first lubricant flow path includes a plurality of turns to increase a distance of the portion of the first lubricant flow path in the heat exchange relationship with the hot gas.

2. The compressor assembly according to claim 1, wherein the first lubricant flow path includes a conduit positioned within the hot refrigerant gas in the discharge port.

3. The compressor assembly according to claim 1, wherein at least a portion the first lubricant flow path wraps around an insert located within an opening of a compressor housing.

4. The compressor assembly according to claim 3, wherein the first lubricant flow path extends generally helically from a first end to a second end of the insert.

5. The compressor assembly according to claim 3, wherein the first lubricant flow path is formed into an exterior surface of the insert.

6. The compressor assembly according to claim 3, wherein the opening configured to receive the insert is formed in a portion of the compressor housing located centrally in the discharge port.

7. The compressor assembly according to claim 1, wherein the first lubricant flow path is integrally formed with a compressor housing.

8. The compressor assembly according to claim 7, wherein the first lubricant flow path is formed about a circumference of a chamber of the discharge port.

9. The compressor assembly according to claim 1, further comprising:

a second lubricant flow path fluidly coupled to at least one of the plurality of connecting passages, at least a portion of the second lubricant flow path being arranged in a heat exchange relationship with a hot gas in the discharge port such that a lubricant within the second lubricant flow path increases in viscosity.

10. The compressor assembly according to claim 9, wherein the first lubricant flow path is fluidly coupled to a first connecting passage and the second lubricant flow path is fluidly coupled to a second connecting passage.

11. A lubrication system for a movable component of a refrigeration system comprising:

a compressor, a condenser, and an evaporator arranged in fluid communication to form a refrigeration circuit;

a reservoir configured to store a supply of lubricant;

a lubricant flow path fluidly coupled to the reservoir, an inlet of the lubricant flow path being arranged generally downstream from a pressure reducing orifice, wherein at least a portion of the lubricant flow path is arranged in a heat exchanger relationship with a hot heating medium provided by one of the compressor and the condenser such that the lubricant within the portion of the lubricant flow path increases in viscosity, the portion of the lubricant flow path includes a plurality of turns to increase a distance of the portion of the lubricant flow path in the heat exchange relationship with the hot heating medium; and at least one connecting passage extending between an outlet of the lubricant flow path and the movable component.

12. The lubrication system according to claim 11, further comprising a plurality of lubricant flow paths, each lubricant flow path being connected to a corresponding connecting passage to provide lubricant having an increased viscosity to at least one movable component.

13. The lubrication system according to claim 11, wherein the hot heating medium is provided from a condenser of a refrigeration system.

14. The lubrication system according to claim 11, wherein the hot heating medium is refrigerant from a discharge port of a compressor of a refrigeration system.

15. The lubrication system according to claim 14, wherein at least a portion of the lubricant flow path includes a conduit positioned within the discharge port of the compressor.

16. The lubrication system according to claim 14, wherein at least a portion of the lubricant flow path wraps around an insert located within an opening of a compressor housing.

17. The lubrication system according to claim 14, wherein the lubricant flow path is integrally formed with a compressor housing.

18. The lubrication system according to claim 11, wherein the movable component is a bearing of a compressor.

* * * * *